US005421340A

United States Patent [19]

Stanga et al.

[11] Patent Number: 5,421,340

[45] Date of Patent: Jun. 6, 1995

[54] COMPACT, PORTABLE CRITICAL CARE UNIT FOR HYPERBARIC AND RECOMPRESSION CHAMBERS

[75] Inventors: Daryl F. Stanga, New Orleans, La.; Edward T. Flynn, Great Falls, Va.

[73] Assignee: The United States of America as represented by the Secretary of the Navy, Washington, D.C.

[21] Appl. No.: 53,542

[22] Filed: Apr. 29, 1993

[51] Int. Cl.[6] ..... A61B 5/0205

[52] U.S. Cl. ..... 128/671; 128/205.26; 128/204.23; 600/21

[58] Field of Search ..... 128/670–671, 128/897–898, 205.26, 202.23, 202.27, 204.18, 204.23; 600/21–22; 604/23–24, 35

[56] References Cited

U.S. PATENT DOCUMENTS 4,003,378 1/1977 Pickering ..... 600/22 X 4,161,172 7/1979 Pickering ..... 600/22

4,296,743 10/1981 Lasley ..... 600/21 X

FOREIGN PATENT DOCUMENTS 1618413 1/1991 U.S.S.R. ..... 600/21

1674836 9/1991 U.S.S.R. ..... 600/21

*Primary Examiner*—Angela D. Sykes

*Attorney, Agent, or Firm*—A. David Spevack; William C. Garvert

[57] ABSTRACT

The advanced care system for use in a hyperbaric chamber is a self-contained, rapidly transportable unit which contains a ventilator, patient suction, and vital signs monitor. It was developed to increase the level of life support available to an injured diver who might require advanced care, along with recompression therapy while being decompressed in an older model decompression chamber or other hyperbaric chamber not equipped with treatment equipment.

4 Claims, 2 Drawing Sheets

COMPACT, PORTABLE CRITICAL CARE UNIT FOR HYPERBARIC AND RECOMPRESSION CHAMBERS

BACKGROUND OF THE INVENTION

1. Field of the Invention

This invention relates to a compact, self-contained, portable unit to safely provide critical care systems, and monitoring systems in a hyperbaric or recompression chamber environment. More particularly, the invention pertains to a unitary "Fly-Away" care system that is self-contained, rapidly transportable, and safely provides a ventilator, suction, and vital signs monitor including at least cardiac monitoring and rectal temperature monitoring for critical care in a hyperbaric or recompression chamber environment.

2. Description of the Prior Art

Through the many advances in equipment and procedures over the past 10 years, diving has become markedly safer. However, it is still possible for a diver to experience a serious injury for which advanced life support and recompression therapy may be needed. Some of the newer and more complex hyperbaric facilities have advanced care and monitoring equipment built into the recompression chambers. Unfortunately, there are very few of these facilities. Most complex facilities are devoted to research or hyperbaric therapy of non-diving related illnesses, and very few are located close to where a serious accident might happen. Most recompression chambers that are located close to the site where divers (divers includes military, civilian commercial and civilian sport divers) are working or recreating do not have advanced medical equipment to provide artificial ventilation or monitor vital signs. In addition, some of the older hospital hyperbaric chambers are not equipped with critical care equipment.

The only way to ventilate a non-breathing patient in most chambers is with hand bagging. The limitations of this method are: 1) inconsistent ventilation rate, tidal volume, and pressure, 2) inability to exhaust oxygen from hyperbaric chamber, 3) need for additional personnel, 4) fatigue of the operator.

In these older or simpler equipped chambers, monitoring vital signs is limited to intermittent, manually measured pulse rate, respiratory rate, temperature, and blood pressure. The limitations of these techniques are: 1) lack of continuous evaluation of patient status, 2) difficult to obtain in hyperbaric chamber (background noise) 3) limited amount of data available, and 4) requires extra personnel.

Equipment for monitoring vital signs and providing critical care services exist on the market place as individual stand-alone equipment. Most of the equipment contains electric motors, unshielded switches and other hazards not suitable for use in the hyperbaric and recompression type environment. In addition, most of this stand-alone equipment is carried on carts or similar equipment that does not fit rapidly, easily, or at all into a hyperbaric or recompression chamber.

SUMMARY OF THE INVENTION

Accordingly, an object of this invention is a single, unitary, easily transportable unit that provides a ventilator system, suction system and vital signs monitor measuring at least cardiac signs, and temperature.

Another object of this invention is a unitary system that operates in the hyperbaric or recompression chamber environment without creating sparks and other hyperbaric hazards.

An additional object of this invention is a unitary system that can fit into and operate in a recompression or hyperbaric chamber.

Yet another object of the invention is a unit that is economical in the consumption of gas needed to operate the systems.

These and additional objects of the invention are accomplished by a single unit containing in one easily carried case in hyperbaric chamber safe form a ventilator means, suction means, and vital signs monitor means measuring at least cardiac system and body temperature for critical care in a hyperbaric or recompression chamber environment.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements. The representations in each of the figures is diagrammatic and no attempt is made to indicate actual scales or precise ratios. Proportional relationships are shown as approximations.

DESCRIPTION OF THE PREFERRED EMBODIMENTS

The Fly-Away Advanced Care System (FAACS) has been conceived and built in order to increase the level of care available to a stricken diver or others in the hyperbaric environment. The most important part of the concept of this invention is a single unit that can be easily transported into a hyperbaric environment without introducing a dangerous situation. That means all parts and operating systems of the unitary care system must be free of spark creating devices. In the most effective embodiment, electric motors are replaced by gas driven power drivers and electric switches etc. are shielded or protected from creating an "ignition point". An ignition point is a heat or spark source sufficient to burn or cause an explosion in a hyperbaric environment. Each individual part of the device exists in concept in the literature or use today but the capabilities or functions have not been incorporated into a single unit that is sized to be easily portable into a hyperbaric chamber.

Figure 1:
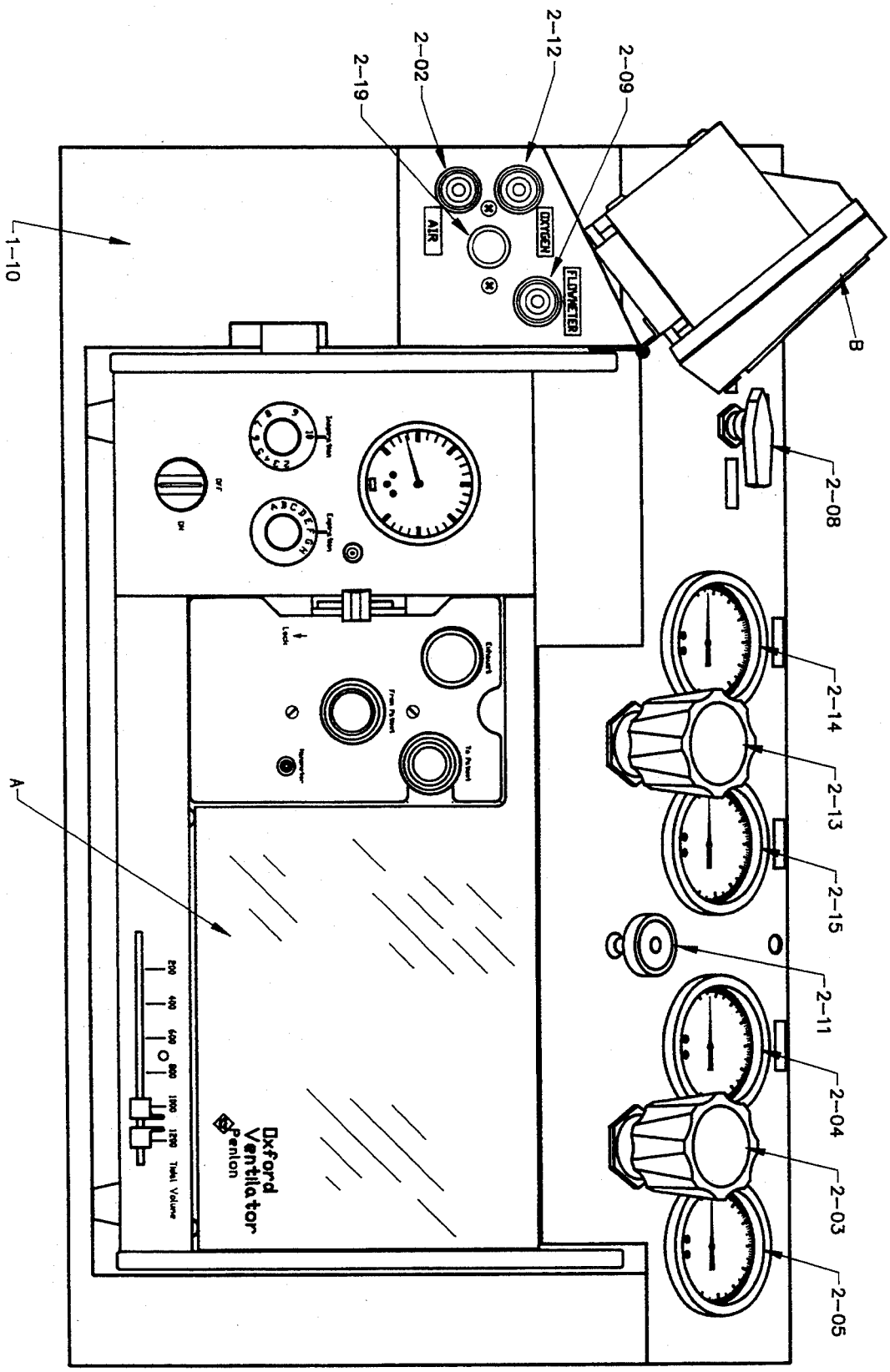
FIG. 1 is a front view of the "Fly Away" unit.

In the most preferred embodiment, the FAACS measures 24 inches long, 15 inches tall, and 15 inches deep, and weighs 70 lbs, (FIG. 1). The metal housing unit contains the piping, gauges, regulators, and fittings to support a Penlon Oxford MK-1 gas driven ventilator (FIG. 1-A), associated anesthesia circuits, an exhaust system and a venturi suction device, as well as a Propac 106 Patient Monitor TM (FIG. 1-B) for monitoring vital signs. The only equipment required to operate the unit that are not packaged with it are: 1) a set of SCUBA cylinders (not shown) to provide driving gas for the ventilator and suction unit, and 2) a supply of patient breathing gas (usually oxygen) which can be provided by a hyperbaric chamber built in breathing system (BIBS).

The metal housing (FIG. 1-10) contains the three main systems of the FAACS: Driving Gas, Patient Gas, and Exhaust Gas.

DRIVING GAS

Figure 2:
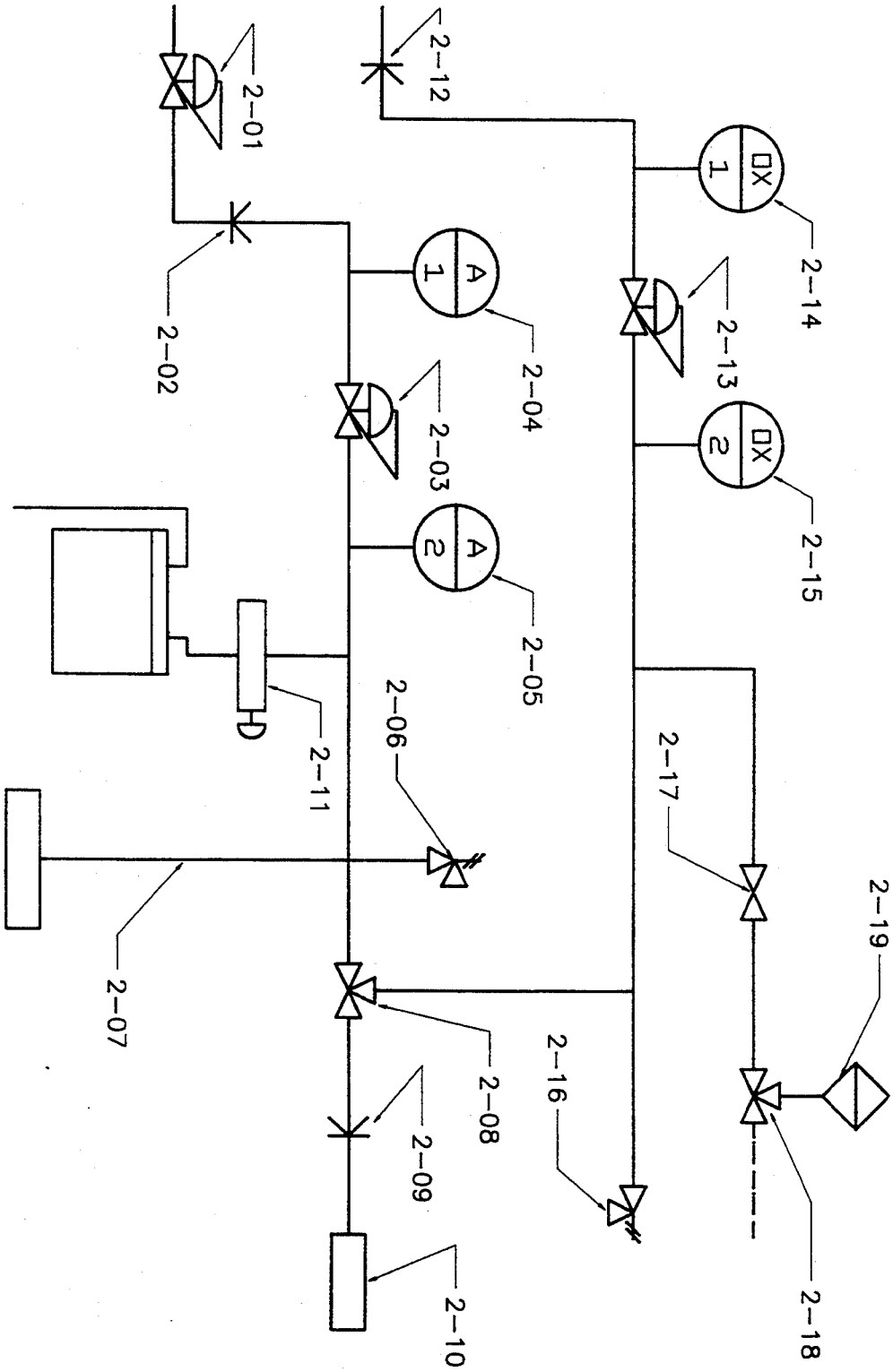
FIG. 2 is a piping schematic of the "Fly Away" unit

The pressurized gas used to drive the ventilator is provided from a set of SCUBA bottles through a Conshelf XIV TM first stage regulator (FIG. 2-01) where it is reduced to 140 psi. The low pressure air then flows through a Gates ⅜" L04090 X4580 flexible hose to a Swaglock black, color-coded, keyed, quick disconnect pt. #SS-QC4-B1-400K1 (QD) (FIG. 2-02) into the box (FIG. 1-10). Once inside the box the air flows through ¼ inch stainless steel pipe rail spec. ASTM A-213-A269. It first passes through a Tescom 44-221X-241 regulator modified with a 44-2263-242 body in order to accommodate gauge ports (FIG. 2-03). Both the inlet and outlet pressures are monitored on Ashcroft 25 1009SW 02B 200 psi. (FIG. 2-04) and 25 1009SW 02B100 psi. (FIG. 2-05) gauges mounted on the front of the box (FIG. 1-10). The 50 psi. outlet pressure is the optimum working pressure of the ventilator and subsystems. After the air leaves the regulators it is piped past a Circle Seal relief valve A-D559B-1M-11 (FIG. 2-06) set at 110 psi. to three subsystems: 1) Driving Gas circuit, 2) Flowmeter Supply, and 3) Patient Suction.

Driving Gas Circuit

The first subsystem brings the 50 psi. driving gas directly to the ventilator via a flexible hose and adapter (FIG. 2-07). The Penlon Oxford MK-1 gas ventilator (FIG. 1-A) allows the operator to control inspiratory and expiratory rate, tidal volume and positive end expiratory pressure (PEEP). It has been successful used in recompression chambers and has a low gas consumption. See references 1, 2, 3, and 4 for a general description of the operation of this commercially available device. It is unaffected by changes in ambient pressure up to 6 ATA. Testing at Naval Medical Research Institute, Bethesda, Md. has shown that a single set of twin 80 SCUBA bottles charged to 3000 psi. would support a patient for the time required to complete recompression treatment according to treatment table 6 of the U.S. Navy Diving Manual (ref. 4).

Flowmeter Supply

In the second subsystem the 50 psi. air is piped to a three way valve that supplies gas to the flowmeter. This flowmeter is used to supply supplemental humidified breathing gas to the patient breathing circuit. This is the breathing gas received by the patient during spontaneous respiration, as opposed to breathing gas received when supplied by the ventilator.

Patient Suction

The third subsystem supplies air to the Flynn Statvac venturi suction model 01A59204 (FIG. 2-11). This unit can be used to orally or tracheally suction a patient. The tubing and collection bottle are stored in the back of the box. Because the use of the suction unit rapidly depletes the SCUBA bottles (23–30 liters per minute), the unit is only used as a secondary suction.

PATIENT GAS

The second main FAACS system is the patient gas system. Gas is usually supplied as oxygen from the chamber Built In Breathing System (BIBS), but standard oxygen flasks or atmospheric air may be used. A ⅜" gates whip #L04090 X4580 is connected to the source with the appropriate QD (assorted sizes of QDs are stored within the FAACS box). The gas is supplied through the whip to a Swaglock green color coded keyed QD #SS-QC4-1-400K3 (FIG. 2-12) into the box. From this point the gas flows through ¼" stainless steel tubing to a second Tescom 44-221X-241 regulator modified with a 44-2263-242 body in order to accommodate gauge ports (FIG.2–13) were it is reduced from supply pressure (usually 100 psi) to 50 psi. The inlet and outlet pressures are monitored by an additional pair of Ashcroft gauges 25 1009SW02B200PSI (FIG.2–14) and 25 1009SW02B100PSI (FIG.2–15) mounted on the box. From the regulator the gas flows past a Circle Seal Relief Valve #A-D559B-1M-110 (FIG.2–16) set at 110 psi. to two subsystems: 1) Patient Breathing Circuit and 2) Flowmeter supply.

Patient Breathing Circuit

The first subsystem is the patient breathing circuit. The gas is piped from the regulator to a Flynn Demand valve model #063-050 (FIG.2–17). As the ventilator bellows are expanded the negative pressure will activate the demand valve supplying gas to the breathing circuit. A 13/16" Collins T-shaped stopcock #P-321 (FIG.2–18) allows the operator to choose whether breathing gas to the patient will be gas from the BIBS or some other source supplied through that demand valve, or gas from the chamber atmosphere drawn through a bacteria filter (FIG.2–19). The gas leaves the ventilator into the anesthesia circuit where it interfaces with the flowmeter FIG. 1) then to the patient.

Flowmeter Supply

In the second subsystem the 50 psi air is piped to a ¼" Whitey SS-42X54 three way valve (FIG.2–08) that supplies gas through a Swaglock yellow, color coded, keyed QD #SS-QC4-B1-400K4 (FIG.2-09), to a Puritan Series C LN47081, 0–15 liter/min. flowmeter. This flowmeter is used to supply supplemental humidified breathing gas to the patient breathing circuit. This gas provides humidification to the breathing gas via an Inspiron #002305-A nebulizer, and is the gas received by the patient during spontaneous respiration, as opposed to breathing gas received when supplied by the ventilator.

EXHAUST GAS

The third main FAACS system is the exhaust gas system. In recompression chambers equipped with a BIBS exhaust system the patient's expired gas will be exhausted through a (PEEP) valve into an extended Bain circuit (a type of anesthesia circuit which contains a tube within a tube) (Encl.3 FIG.2). The outer tube of this circuit has a floodable volume of 1200 cc (which is the maximum volume output of the ventilator). The inner tube is connected to a Whitey needle valve #B-1VF4-A behind a Puritan Bennett #122300 suction regulator on the ½" Scott BIBS exhaust hose by a length of ¼" tygon tubing. A recompression chamber BIBS exhaust system usually operates at approximately 10 psi. less than chamber pressure. As the patient exhales, he fills the outer tube with his expired gas. The inner tube, which ends 2" from the ventilator exhaust port, will draw the expired gas from the outer tube through the tygon tubing into the BIBS exhaust system. The distal end of the Bain circuit is open to chamber atmosphere to replace the gas being exhausted from the circuit. If the patient is receiving oxygen concentrations greater than ambient, the adequacy of exhaust suction can be determined by monitoring the oxygen level at the open end of the Bain circuit with a portable oxygen monitor. If the oxygen level at this point is the same as chamber atmosphere, suction flow is sufficient. If the recompression chamber has no BIBS exhaust system the patient's expired gas will be exhausted to chamber atmosphere.

Vital Signs are monitored with the Protocol Propac 106 patient monitor (FIG. 1-B), a battery operated monitor with an LCD screen. It is possible to monitor 3-lead EKG, invasive pressure of two lines (arterial or venous), non-invasive blood-pressure, and pulse, and temperature. The monitor's battery will last approximately 8.5 hours. If the back-light and the non-invasive blood-pressure cuff are used extensively, battery life will be shortened. The monitor can be easily removed from the FAACS and placed in a more convenient location as needed by the medical provider.

The monitor and battery have been tested by their respective manufacturers. These test results as well as the technical manuals have been reviewed by NAVSEA OOC Diving and Salvage who judged the unit to be safe for chamber use. The Propac 106 will be on the next revision of the ANU (Authorized for Navy Use) list for recompression chambers.

This system will greatly enhance the medical care to the injured diver who requires advanced life support during recompression treatment. The main advantages of the FAACS are:

1) It provides a ventilator, suction and vital signs monitor in a self contained package;
2) It is lightweight and easily transported world-wide to remote locations;
3) It can be used in any USN standard recompression chamber;
4) It can be operated independently of a recompression chamber; and
5) The gas consumption of the individual components is such that a USN treatment table
6(ref. 4) can be completed with a single set of twin 80 SCUBA cylinders.

The alternative method to achieve this level of care would be to modify existing recompression chambers. This method would be very expensive, take many years, and require recertification of all modified chambers.

Obviously, many modifications and variations of the present invention are possible in light of the above teachings. It is therefore to be understood that, within the scope of the appended claims, the invention may be practiced otherwise than as specifically described.

What is claimed is:

1. A portable, heat and spark hazard free, self-contained life support system adapted for use in an oxygen rich environment of a hyperbaric chamber comprising, a) a ventilator means to provide artificial ventilation for a patient in need,
b) a vital signs monitor to obtain vital signs from said patient,
c) a patient suction system to orally or tracheally suction the patient,
d) a portable housing unit containing said ventilator means, vital signs monitor and said patient suction system said ventilator means, said vital signs monitor and said patient suction system being adapted to provide advanced life support for a patient in the hyperbaric chamber environment without the need for a hyperbaric chamber to be so equipped.

2. The portable, self-contained life support system of claim 1, wherein said housing unit is adapted for external means of supplying oxygen for attachment to said patient and driving gas for the ventilator means.

3. The portable, self-contained life support system of claim 1, wherein said ventilator means, said vital signs monitor and, said suction system are powered electrically by a battery adapted for a hyperbaric environment.

4. A method for providing life support in a hyperbaric chamber environment using a self-contained system mounted in a portable housing, said system comprising, a) a ventilator to provide artificial ventilation for a patient in need,
b) a vital signs monitor to obtain vital signs from said patient, and
c) a patient suction system to orally or tracheally suction the patient, and
d) a portable housing unit containing said ventilator, said vital signs monitor and said patient suction system said method comprising providing advanced life support for a patient in the hyperbaric chamber environment without using said system the need for a hyperbaric chamber to be so equipped.

* * * * *